US007601070B2

(12) United States Patent
Schmidt

(10) Patent No.: US 7,601,070 B2
(45) Date of Patent: Oct. 13, 2009

(54) COVERED BILLIARD TABLE WITH HIGH SIDE CLEARANCE

(76) Inventor: Kurt T. Schmidt, 720 Koeln Ave., Ballwin, MO (US) 63111

( * ) Notice: Subject to any disclaimer, the term of this patent is extended or adjusted under 35 U.S.C. 154(b) by 99 days.

(21) Appl. No.: 11/765,301

(22) Filed: Jun. 19, 2007

(65) Prior Publication Data

US 2008/0318696 A1 Dec. 25, 2008

(51) Int. Cl.
*A63D 15/04* (2006.01)
*A47C 17/62* (2006.01)

(52) U.S. Cl. ..... 473/10; 473/29; 473/15

(58) Field of Classification Search ..... 473/1, 473/4, 6, 9, 10, 14, 16
See application file for complete search history.

(56) References Cited

U.S. PATENT DOCUMENTS 1,534,711 A * 4/1925 Hoskin ..... 473/29
1,540,316 A * 6/1925 Clement ..... 473/11
1,661,965 A * 3/1928 Ruse et al. ..... 473/13
2,008,613 A * 7/1935 Hernes ..... 108/90
2,391,395 A * 12/1945 Debicki ..... 473/29
2,572,333 A * 10/1951 Greitzer ..... 108/90
2,719,717 A * 10/1955 Verity ..... 273/126 R
3,048,459 A * 8/1962 Moore ..... 108/90
3,263,996 A * 8/1966 Braun ..... 473/33
3,458,193 A * 7/1969 Rockwood et al. ..... 473/22
3,584,872 A * 6/1971 Nielsen ..... 473/15
3,729,192 A * 4/1973 Nielsen ..... 473/30
3,871,655 A * 3/1975 Zimmers et al. ..... 273/123 R
3,941,378 A * 3/1976 Bagley ..... 473/10
5,054,776 A * 10/1991 Wyman ..... 473/34
5,161,797 A * 11/1992 Frasca ..... 473/29
5,839,966 A * 11/1998 Eisenhauer et al. ..... 473/29
6,659,879 B1 * 12/2003 Cartwright ..... 473/8
6,712,711 B1 * 3/2004 Skelton et al. ..... 473/10
6,962,535 B2 * 11/2005 Cartwright ..... 473/8
7,229,360 B2 * 6/2007 Chevillotte ..... 473/4

* cited by examiner

*Primary Examiner*—Mitra Aryanpour
(74) *Attorney, Agent, or Firm*—Charles McCloskey

(57) ABSTRACT

A covered billiard table with seating clearance for diners is a billiard table that also serves as a dining table. The table has two end covers and two middle covers that span across it. The covers rest upon a billiard table of slates upon a frame with four legs. To play billiards, people remove the covers to reveal the playing surface: cloth covered slates with side rails and perpendicular end beams joined at corners, shown with pockets. This table has the clearance beneath the frame for a seated person's legs. The frame has a pattern of supported braces joined to beams upon the side panels and to the end beams and end panels. The frame and beams have sufficient stiffness to limit deflection of the slates and to provide clearance for a person to sit beneath the table.

4 Claims, 9 Drawing Sheets

COVERED BILLIARD TABLE WITH HIGH SIDE CLEARANCE

BACKGROUND OF THE INVENTION

The covered billiard table with seating clearance for dining generally relates to billiard tables and more specifically to a billiard table that has a high side clearance for a seated person's legs to fit comfortably beneath the table.

For over a century, people have played billiards, pool, snooker, and related games on tables. In the games, particularly billiards, phenolic balls are hit, with the tip of a cue stick, across a table to another ball which falls into a pocket or the ball itself enters the pocket for score. From earlier times, billiards has been played in halls of sufficient size to accommodate numerous tables. Each table has at least two pieces of slate installed horizontal with an overall size approximately four foot wide by eight foot long. The table has sidewalls that have bumpers for containing the balls upon the table during play and pockets at strategic locations for scoring opportunities. The sidewalls generally descend below the level of the slate, or tabletop, and conceal the framework and ball handling equipment. In pool halls and billiard parlors, the buildings are large enough and tables spaced apart so players can walk readily around a single table or between tables.

In more recent decades, people have played more and more billiards at home. Garages and particularly basements have had enough size to admit a billiard table. The tables are usually brought into the basement in pieces and assembled by select installers. The installers build the frame for the table and then install the slates, making sure the slates are level in both directions to within tolerances. Billiard tables have proved especially popular among the baby boom generation.

However, as billiard table owners sell a house or age, they often downsize their residences. More and more billiard table owners find themselves in condominiums, apartments, and small houses, some without basements. Some downsized residences have little room for a stand alone billiard table, let alone a billiard table and a dining room table.

DESCRIPTION OF THE PRIOR ART

Seeking to maximize space in a smaller residence, billiard table owners look for a combination of billiard table and dining room table. As people need to eat, a dining room table remains regardless of the size of the residence. As a dining room table has similar dimensions to a billiard table, a combination of the two allows for both uses in the same space. Billiards loving people can play their game in a smaller residence. At other times, prior inventions have combined a billiard table and a dining room table in various ways.

The patent to Clement, U.S. Pat. No. 1,540,316 shows an early billiard table for dining use that has perimeter cushions upon a frame. The table begins as flat for dining and then the cushions are raised for billiard play. A lever mechanism raises and lowers the cushions as desired which is not the present invention.

The patent to Ruse et al., U.S. Pat. No. 1,661,965 shows another early billiard device for use on a tabletop, including a dining table. This device shows frames with attached cushions placed upon a tabletop. The frames are secured with clamps that grip beneath the table. Billiards is played directly upon the tabletop surface. The patent does show pockets but does not disclose covers suitable for dining over a billiard table.

The patent to Zimmers et al., U.S. Pat. No. 3,871,655 describes a table for use dining or playing cards or billiards.

Here, a single piece tabletop rests upon a billiards playing table. The removable tabletop has a dining surface and an opposite card playing surface with chip holders. The billiards playing table has tracks for a sliding ball box in two or four locations. A rib and matching notch prevent the tabletops from sliding upon each other.

The patent to Bagley, U.S. Pat. No. 3,941,378 has another convertible table that mentions a second tabletop for dining upon a pool playing surface. The patent then describes trays that store beneath a table and swing downwards to release balls for play in pool. This table has covers for a pool table when dining, and indicates a proper height for seated people.

The patent to Wyman U.S. Pat. No. 5,054,776 shows a pool table cover that converts an existing billiard table for dining. The cover has a fabric top that covers hinged blocks that occupy the space between the billiard playing surface, adjacent cushions, and the height for dining. The present invention though describes a billiard table with an under frame height to admit the legs of a sitting person which this patent does not disclose. The covers of the present invention, not connected, span over the billiard playing surface in contrast to this patent that has covers occupying that surface.

The patent to Cartwright, U.S. Pat. No. 6,659,879, has a convertible table with side rails that store below. This table has a height for normal use in dining and a tabletop for dining and billiards. When used for billiards, side rails are raised from below and up to the table surface. The side rails move upon arms in a vertical direction and the arms are stored in a horizontal direction below that table surface.

The other patent to Cartwright, U.S. Pat. No. 6,962,535, has a convertible table with side rails that store below and covers. This patent though adds cover members, as at 70, generally located above and outward from the side rails of the previous patent. The covers are designed to expand the tabletop and remain in its same plane.

The present invention seeks to overcome the disadvantages of the prior art and provide additional advantages not heretofore shown. As the present invention serves dual purposes, it accommodates the restrictions of each. The present invention has a billiard table with flat slates within tolerances and deflection limits, bumpers, and pockets. Additionally, the billiard table has a flat surface suitable for dining thereupon by diners seated adjacent to the table with their legs under the table.

SUMMARY OF THE INVENTION

Generally, the present invention of a covered billiard table with seating clearance for dining is a billiard table that also serves as a dining room table for seated diners. The table has two outer covers and two inner covers between them that span across the table. The covers rest upon a frame with four strong legs depending from the corners. The frame has side beams, lengthwise, and end beams across. A key feature of the table is the clearance beneath the frame that allows a person's legs to fit under the table. When desiring to play billiards, people remove the covers to reveal the playing surface of a classic billiard table. The playing surface has cloth covered slates with side rails and perpendicular end rails joined at corners, shown with pockets. Each cover has a top surface for dining with two parallel and spaced apart end plates, and in an alternate embodiment, a spacer. The frame has substantial braces joined to end beams. The braces have sufficient stiffness to limit deflection of the slates while maintaining the clearance for a person to sit beneath the table. The framework that supports the slates has a generally grid form with reinforced joints.

There has thus been outlined, rather broadly, the more important features of the invention in order that the detailed description thereof that follows may be better understood and that the present contribution to the art may be better appreciated. The present invention also includes a framework that supports slates according to official billiards rules and deflection limits, mechanical fasteners, adhesives, reinforcing beams, and laminated woods, Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved covered billiard table with seating clearance for dining.

Another object is to provide such a covered billiard table that allows for the play of billiards thereupon and also for dining thereupon.

Another object is to provide such a covered billiard table under which persons may pass their legs when seated, as in dining.

Another object is to provide such a covered billiard table that meets or exceeds the deflection requirements of the table surface for official billiards play.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
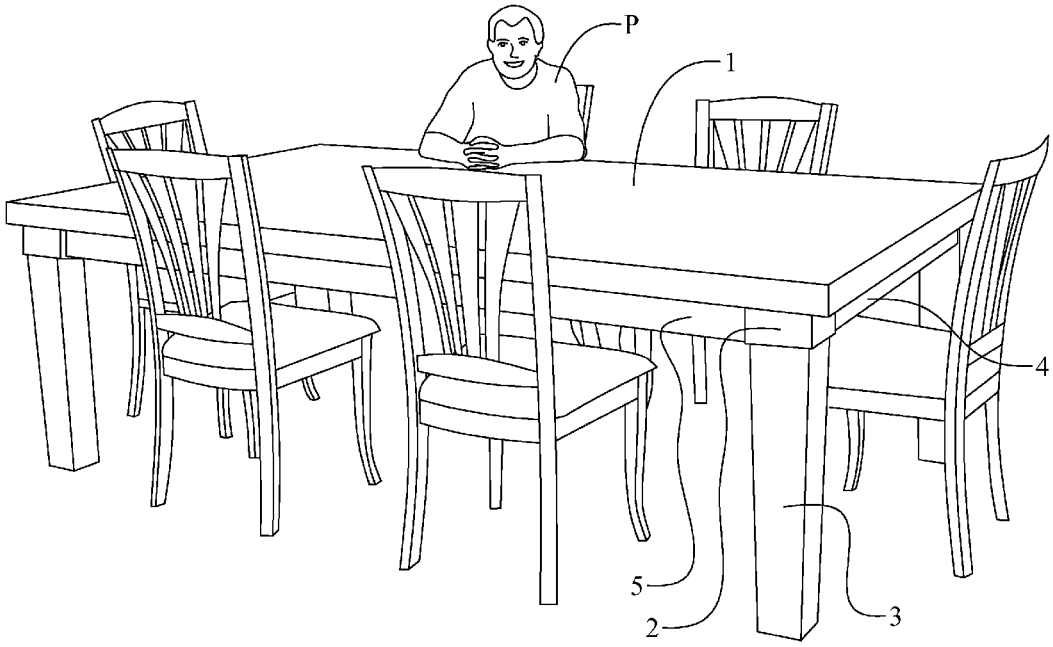
FIG. 1 shows a perspective view of the present invention with the covers in place.

The present art overcomes the prior art limitations by providing a covered billiard table 1 that has a seating clearance for diners, in FIG. 1. The table 1 allows for play of billiards when desired and then usage as a dining table on a regular basis. The table 1 has a generally rectangular shape and a structure in support thereof beneath the surface of the table. The table overhangs the width and the length of the structure. The structure 2 has four legs 3 generally at the corners of the table 1 and each leg extends perpendicular and below the table. Each leg connects to a lateral member, or end panel decorated with appropriate trim, as at 4 and a longitudinal member, or side panel decorated with appropriate trim, as at 5 of the structure. The lateral members are mutually parallel and spaced apart, and the longitudinal members are mutually parallel and spaced apart and perpendicular to the lateral members. The lateral members and longitudinal members cooperate to form a rectangular opening into which attaches the framework 6 later described in FIG. 7. As shown in FIG. 1, a person P can be seated at the table 1 with arms pleasantly upon the surface of the table when covered and legs beneath the table as when using a table for dining. The table has a clearance of at least 24 inches below the framework.

Figure 2:
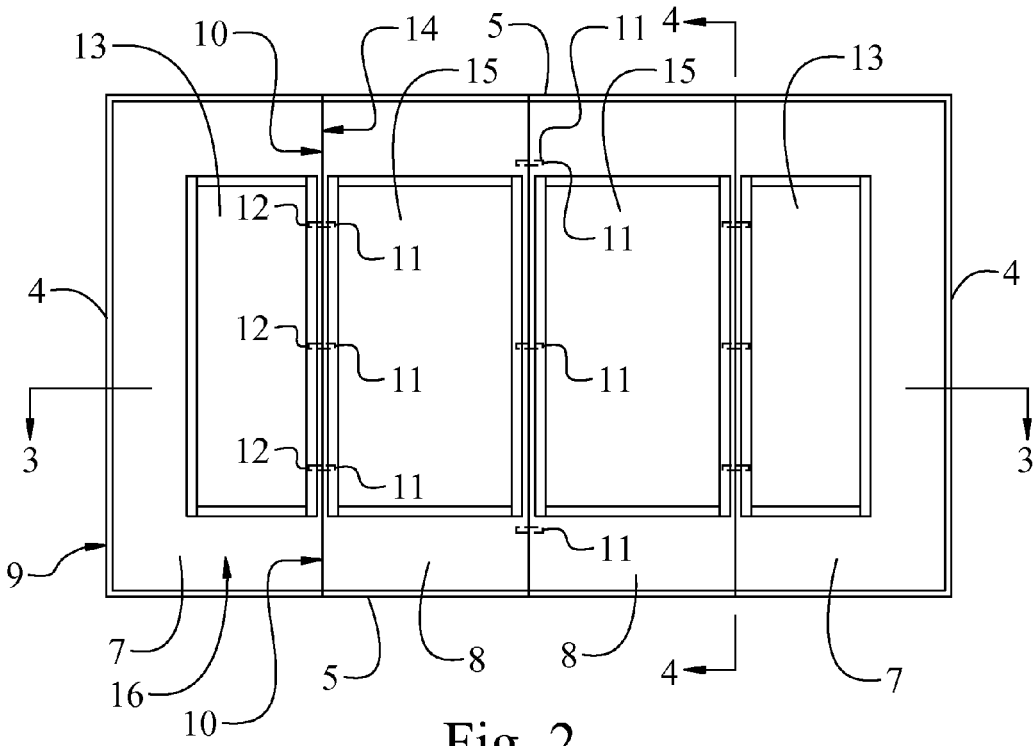
FIG. 2 describes a bottom view of the covers of the present invention.

The present invention has a billiard table concealed beneath the covers of the table 1 in FIG. 2. The table has two outer covers 7 and two inner covers 8 located between the outer covers. The outer covers are located adjacent to the lateral members 4. Each outer cover is generally rectangular and planar in shape with an exterior edge 9 located at the lateral end of the table and an interior edge 10 towards the interior of the table and two spaced apart plates 30 generally locating upon the longitudinal members 5 of the billiard table. The interior edge and the exterior edge are mutually parallel and the follow the length of the outer cover, or the width of the table. The interior edge 10 abuts an inner cover 8 and has at least two, and preferably three, pinned connections with cooperating pins 11 and holes 12. The holes extend perpendicular to the interior edge and in cooperation with the pins align an outer cover 7 to an adjacent inner cover 8.

An alternate embodiment of the outer cover 7 includes a rectangular frame mounted upon the underside of the outer cover. The rectangular frame stiffens the cover so that it may span the width of the playing surface and support the loads imposed by diners and food service upon the outer cover. The frame supports this cover when it abuts the two sides, as at 5, and one end, as at 4, of the table. The rectangular frame has generally tubular members inset from the plates 30 an offset amount, such as that indicated by 16. The rectangular frame fits within the rails of the billiard table to prevent rubbing by the cover upon the table and to prevent incidental movement of the cover by diners and the risk of scratching the top surface of the rails. The rectangular frame barely touches the slates when under full load. Preferably, the rectangular frame has members of cloth covered wood approximately 1.5 inch by 1 inch in cross section with corner joints rounded to prevent cutting or abrading the inserts described below and the cloth surface cover of the members prevents cutting or abrading the rails or the inserts below. Alternatively, the frame has tubular steel members encased within cloth and the members also have an approximate cross section of 1.5 inch by 1 inch.

Located below the outer cover, a separate foam insert 13 protects the slates below. Covered in vinyl, the foam insert is generally centered upon the outer panel and has a width and length that are offset from the exterior edge 9 and the plates 30. The vinyl cover extends continuously from end to end and side to side and in so doing, minimizes leakage of food and liquids through the insert onto the slates below. The foam insert fits within the playing surface of the table, that is between the cushions or bumpers, and the vinyl cover has flaps upon the two lateral ends and at least one of the longitudinal sides of the foam insert. The flaps separate the wood of the outer cover 7 from the wood of the side panels 5 and lateral members 4. The insert generally has four sections, mutually parallel and slightly spaced apart, that are sewn within the vinyl cover. The sewing pattern in cooperation with the vinyl cover allows folding of the foam insert, generally like an accordion or interleaving, for storage of the foam insert when the invention is used for billiard play. Though a foam insert is preferred, alternate embodiments using round or other shaped frames and rigid, or semi-rigid, foam boards are foreseen by the applicant. An offset 16 identifies that the insert 13 has less length than the cover as the insert fits within the rails, or cushions, of the billiard table located upon the longitudinal members 5.

Adjacent to each outer cover 7 is an inner cover 8. Each inner cover is generally rectangular, symmetric, and planar in shape with mutually parallel and spaced apart interior edges 14 generally locating away from the lateral ends 4 of the table. Each inner cover has a foam insert 15 as previously described for insert 13. Each inner cover also has two spaced apart plates 30 generally locating upon the longitudinal members 5 of the billiard table. The interior edges follow the length of the inner cover or the width of the table. The interior edge 14 abuts either an adjacent outer cover or the second inner cover, generally at the center of the table. The inner cover 8 on the interior edge 14 abutting the outer cover has at least two, and preferably three, pinned connections with cooperating pins 11 and holes 12 generally spaced closer together and within the length of the foam insert 13. And, the inner cover 8 on the interior edge abutting the interior edge of the other inner cover has at least two, and preferably three, pinned connections with cooperating pins 11 and holes 12 generally spaced farther apart than the holes with the outer cover and outside within the length of the foam insert. The holes extend perpendicular to the interior edges 14 and in cooperation with the pins align an inner cover 7 to an adjacent outer cover 8 or the other inner cover.

An alternate embodiment of the inner cover 8 includes a rectangular frame mounted upon its underside, perhaps as a supplement for the foam insert. The rectangular frame stiffens the inner cover so that it may span the width of the playing surface and support the loads imposed by diners and food service upon the inner cover. This rectangular frame supports the cover when it spans from the two sides only, as at 5, of the table. The rectangular frame has generally tubular members inset from the plates 30 an offset amount, such as that indicated by 16. The rectangular frame fits within the rails of the billiard table to prevent rubbing by the cover upon the table and to prevent incidental movement of the cover by diners and the risk of scratching the top surface of the rails. The rectangular frame does not touch the slates when under full load. Preferably, the rectangular frame has members of cloth covered wood approximately 1.5 inch by 1 inch in cross section with corner joints rounded to prevent cutting or abrading the inserts described below and the cloth surface cover of the members prevents cutting or abrading the rails or the inserts below. Alternatively, the frame has tubular steel members encased within cloth and the members also have an approximate cross section of 1.5 inch by 1 inch.

Figure 3:
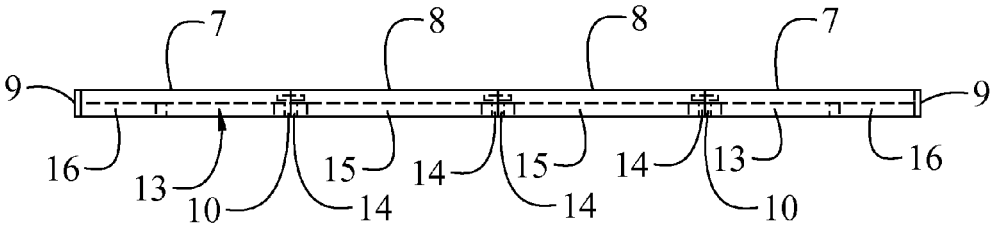
FIG. 3 is a side view of the covers when ganged, generally upon the length of the present invention.

The covers are arranged outer cover, inner cover, inner cover, and outer cover in the preferred embodiment as shown in FIG. 3 along the length of the invention. As before, an outer cover has a rectangular shape with two plates 30 upon the longitudinal members 5. One end is shown in this side view where the outer cover has its surface upwardly and the foam insert 13 below with an offset 16 located away from the center of the covers. Upon the interior edge 10, the outer cover 7 abuts an inner cover 8 connected by pins 11. The inner cover also has its surface upwardly and generally coplanar with the surface of the outer cover and a foam insert 15 below. The foam inserts, 13, 15 are also coplanar between adjacent outer cover and inner cover, and the inner covers. The foam inserts protect the rails by making contact with the slate, thereby keeping the cover and rails separated when the table is covered for dining. As shown in this figure, the preferred embodiment has two outer covers with two inner covers in between. The number of covers can be changed to suit the taste of an owner of the present invention though the outer covers will remain two in number.

Figure 4:
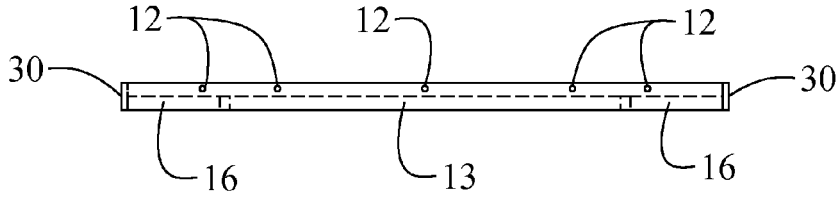
FIG. 4 is a side view of a cover where the cover spans the width of the invention.

Viewing an outer cover from the side and from the interior edge 14 in FIG. 4, the outer cover has a length generally proportional to the width of the table. The outer cover has its surface upwardly and a foam insert 13 below. The foam insert is generally centered upon the underside of the outer cover with a length that provides an offset 16 on each end that admits a rail. As before, the foam insert, using the flaps of the vinyl cover, protects the rails by keeping the cover and the rails separated when the table is covered for dining. The vinyl cover extends continuously from end to end and side to side and in so doing, minimizes leakage of food and liquids through the insert onto the slates below. This figure generally shows the pattern of holes 12, five of varying spacing where an outer cover connects by pins to an inner cover. In an alternate embodiment the pattern of holes has three holes of consistent spacing across the interior edges of the outer covers and the inner covers.

Figure 5:
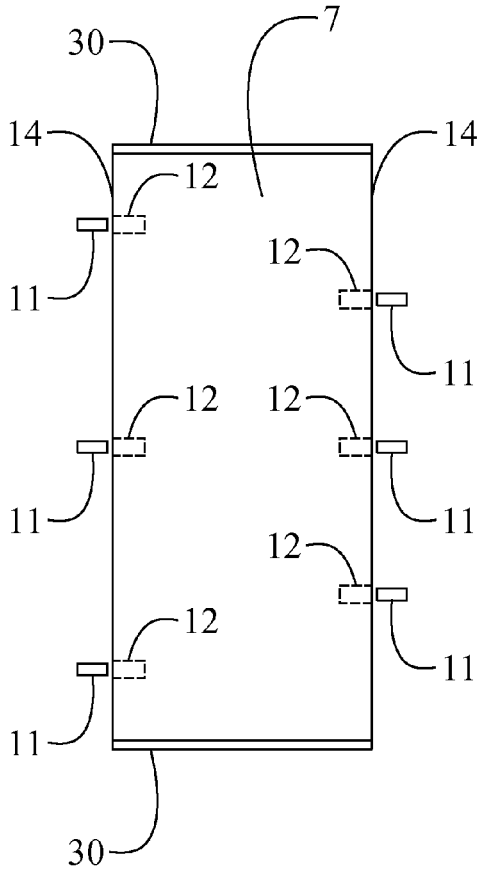
FIG. 5 shows a top view of an inner cover and pins.
Figure 6:
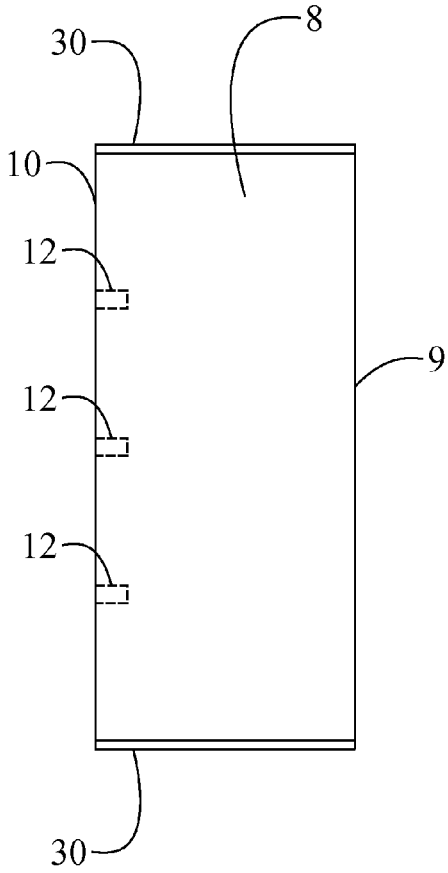
FIG. 6 illustrates a top view of an outer cover and pins.

FIG. 5 shows the pins 11 and the holes 12 of an inner cover 7 from the top. The inner cover has generally three pins 11 on each interior edge with the pins spaced farther apart upon the interior edge abutting the other inner cover and the pins spaced closer together upon the other interior edge that abuts an outer cover 8. FIG. 6 shows an outer cover with holes 12 upon the interior edge 10 only that accept pins 11 for a connection with the interior edge 14 of an inner cover 7.

Below the removable covers 7, 8, the table 1 has at least two slates for the playing surface of various billiard type games. For billiard games proper movement of the balls is required. Players of billiards, especially the skilled, can note when the slates are out of plane or even cracked. Generally, the slate, or the playing surface, must be capable of maintaining an overall flatness within +/−0.020 inch lengthwise and +/−0.010 inch across the width. And, further, the playing surface should have an additional deflection not to exceed 0.030 inch when loaded with a concentrated force of 200 pounds at the center of the playing surface. These deflection limits are enforced, particularly for championship play, and manufacturers certify their tables as meeting the deflection limits. Additionally, the playing surface, generally slate, is brittle and requires support at various locations. The present invention supports the slates within or better than the deflection requirements while providing a clearance below the slates for a person to be seated. The clearance and deflection requirements leave a limited vertical space between the slates and the seated person. In this limited vertical space above the knees of a seated person, the present invention supports the slates upon a framework 6 as shown in FIG. 7.

Figure 7:
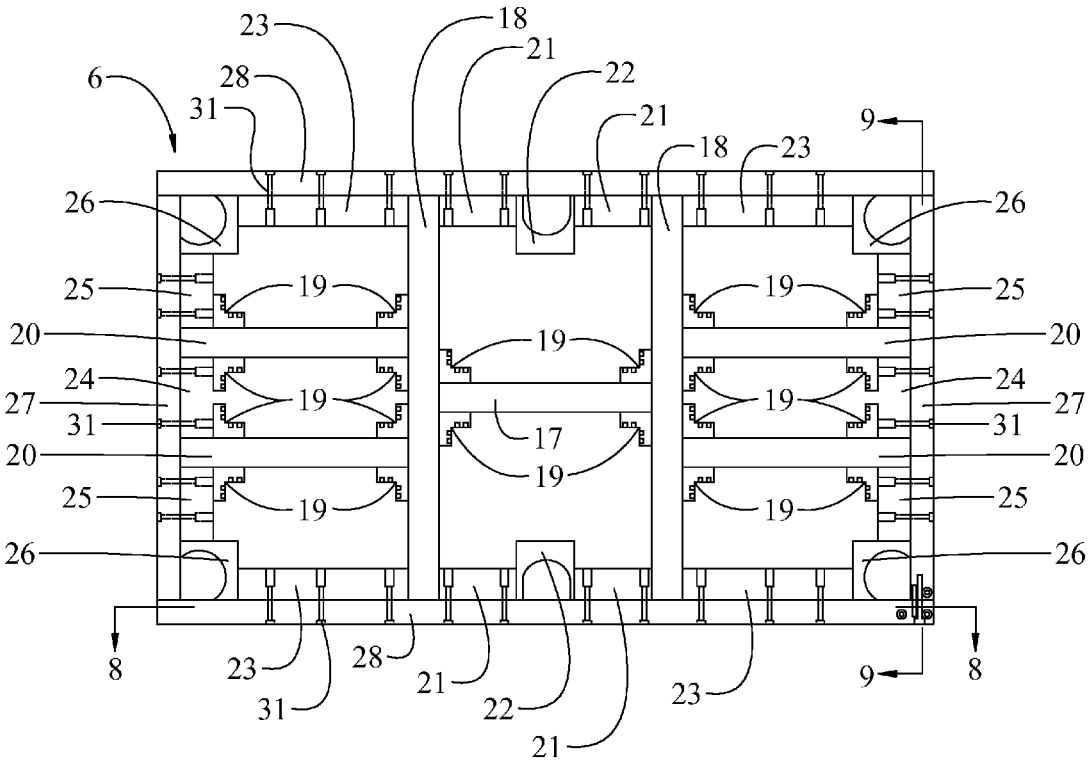
FIG. 7 describes a top view of the framework of the present invention.

Located within the trimmed side panels, as at 5, and end panels, as at 4, of the billiard table, the framework has a generally rectangular shape in FIG. 7 to support the slates as a playing surface subject to official billiards deflection and other criteria. As vertical space is limited below the framework, the component members have a shallow thickness, height, or depth. The framework begins with a center length brace 17, generally centered within the frame and extending upon the longitudinal axis of invention. The center length brace has two opposed ends 17*a*, 17*b*, and a generally rectangular cross section and a length approximately one third of the length of the framework 6. Upon each end 17*a*, 17*b*, the center length brace connects to a cross brace 18. The framework has two cross braces generally perpendicular to the center length brace 17 and that generally span the width of the framework. The cross braces have a rectangular cross section similar to that of the center length brace. The center length brace connects generally to the center of the cross brace with at least one and preferably two angle braces 19. The angle braces are an L shape with two equal length legs that provide a mechanical connection between to component members of the framework. Each leg of an angle brace allows for two mechanical fasteners 31, such as bolts or screws. Load from the slates themselves and loads placed upon the slates are transferred through the angle braces 19 from the center length brace 17 to the cross braces 18. On the opposite side of the cross brace from the center length brace, each cross brace has two outer length braces 20 that connect perpendicular to the cross brace. The outer length braces connecting to each cross brace are mutually parallel and parallel to the center length brace. The outer length braces 20 are spaced apart at slightly less than one third the width of the framework 6. At the cross braces 18, the outer length braces 20 connect to the cross brace using the angle braces 19 with mechanical fasteners as previously described. The framework has four outer length braces.

Outwardly of the aforementioned center length brace 17, cross braces 18, angle braces 19, and outer length braces 20, the framework has additional braces near the perimeter to which the aforementioned braces connect. Inwardly of the cross braces 18, each cross brace connects to a center side brace 21 where the center side brace is perpendicular to the cross brace and extending towards the center of the table along the longitudinal side of the table. The center side brace is rectangular in cross section and has a length approximately one third of the distance between the cross braces. Each end of a cross brace connects to a center side brace and thus the framework has four center side braces 21. Between each pair of center side braces, the framework has a side pocket frame 22. The side pocket frame 22 provides an approximately 0.75 inch thick plate that holds a pocket net open (not shown), that serves as a surface to staple the cloth upon the slate, and that has an opening through which a pocket net and billiard balls shot therein may pass. The underside of the side pocket frame has a snap to assist in closing or collapsing the pocket when the table is configured for dining. The side pocket frame generally has a greater width than the center side braces to admit a billiard ball and the pocket material. The side pocket frames join to the side braces 21 by adhesive, or glue, and mechanical fasteners but do not bear any portion of the weight of the slates.

Upon each end of the cross brace and opposite the center side brace, an outer side brace 23 connects to the cross brace perpendicularly. The outer side brace has similar width as the center side brace and a rectangular cross section. Each outer side brace is collinear with a center side brace and generally of greater length than a center side brace. The present invention has four outer side braces that extend from each end of the cross brace outwardly towards the lateral end panel 4 of the table 1.

Returning to the framework in the vicinity of the lateral end, each pair of outer length braces 20 has a long end brace 24 connected to them by angle braces 19 and mechanical fasteners as previously described. The long end brace 24 is generally perpendicular to the outer length braces 20 and of greater length than a center side brace 21. The long end braces are generally parallel to the cross braces 18 and proximate to a lateral end. The framework has two long end braces 24, one at each lateral end 4. Upon each outer length brace 20 and opposite the connection with the long end brace 24, a short end brace 25 connects perpendicular to the outer length brace. Each short end brace is in line with the nearby long end brace and of similar rectangular cross section. Each short end brace has lesser length than the long end brace and connects to the outer length brace with an angle brace and mechanical fasteners. Opposite the connection to the outer length brace, each short end brace connects to a corner pocket frame. The framework has four short end braces 25 and four corner pocket frames 26. Similar to the side pockets 22, each corner pocket frame 26 provides an approximately 0.75 inch thick plate that holds a pocket net open (not shown), that serves as a surface to staple the cloth upon the slate, and that has an opening through which a pocket net and billiard balls shot therein may pass. The underside of the corner pocket frame has a snap to collapse the pocket when the table is configured for dining. Each corner pocket frame is generally square in shape when viewed from the top and each edge is longer than the short end braces. Each corner pocket frame has a round opening through which passes billiard balls shot into pocket material placed therein. The corner pocket frames join to an outer side brace 23 and short end brace 25 by glue and mechanical fasteners proximate the side 5 and end 4 of the table but do not bear any portion of the weight of the slates.

In an alternate embodiment, the framework 6 has a single end brace to replace braces 24, 25. The single end brace spans from pocket frame 26 to pocket frame 26 upon each end of the billiard table. As the single end braces span nearly the width of the framework, the outer length braces 20 are shortened in this embodiment, by the width of the single end brace, but remain connected to the single end brace using the angle braces 19 and mechanical fasteners, as at 31.

Upon each lateral end of the table, as at 4, the framework 6 has an end beam 27 that spans substantially the width of the table 1. Each end beam connects to the corner pockets and has the short end braces and the long end brace fasten to it. The end beam 27, within the trim proximate 4, is generally flush with the outer length braces for a flat fit of the slates thereupon. Additionally, the center length brace 17 is flush with the cross braces 18, which are flush with the outer length braces 20 so that a smooth plane is formed upon which the slates rest. Each end beam has a generally rectangular cross section of lesser width than the outer side braces. Each end beam has an approximately 2.875 inch thickness and approximately 2.5 inch width of laminated hardwood with the plies and glue lines extending vertically, or for the thickness, of the end beam. The short end braces 25 and the long end brace 24 generally connect to the end beam parallel to the length of the end beam with mechanical fasteners parallel to the plane of the center length brace 17.

Figure 7A:
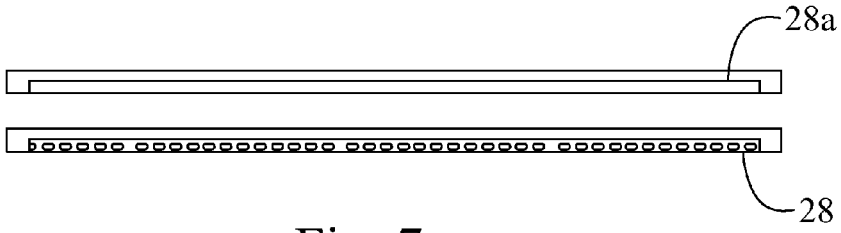
FIG. 7*a* shows a view of the steel infill beam and recess therefore.
Figure 7B:
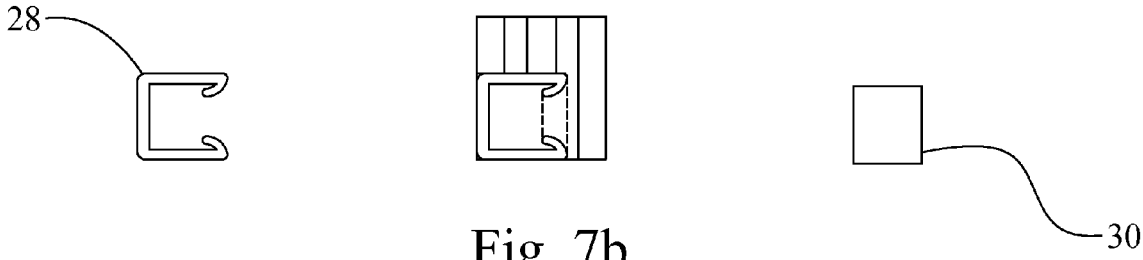
FIG. 7*b* shows the cross section of the steel infill beam.

Defining each longitudinal side of the table, as at 5, the framework 6 has a support beam 28 and an infill beam 28*c*, generally made of steel, positioned within a routed recess lengthwise into the wood of the support beam 28 as shown in the detail of FIG. 7*a*, as at 28*a*. The framework has two mutually parallel and spaced apart support beams 28. Each support beam extends for slightly less than the length of the table, approximately 85.75 inches and includes the ends of the end beams. The support beams 28 have similar width as the end beams 27. Each infill beam has a generally C shaped steel cross section, as in FIG. 7*b*, with a vertical web and parallel horizontal flanges that is hollow and fitted into a recess in the support beam 28 of a total length of approximately 90.875 inches. The web is approximately 1.625 inches tall and the flanges are approximately 1.625 inches wide. FIG. 7*b* shows the support beam 28 towards the bottom and outer corner of the side panel 5. The side panel, in the vicinity of the support beam 28, is a lamination of hardwood strips, at least four and preferably five with the glue strips of the lamination oriented vertically, or perpendicular to the playing surface. The support beam 28 is approximately 2.875 inches in thickness and approximately 2.5 inches in width. During assembly of each support beam, a wooden insert board 30 is inserted between the flanges of the infill beam 28*c* that occupies the hollow space of the C shaped cross section for the length of the support beam. The insert board has a thickness of approximately 1.438 inches, a width of approximately 1.25 inches, and a length of approximately 85 inches to fit within the infill beam 28*c*. The infill beam, fitted into the recess, has its web located outwardly of the rail and upon the outside of the table.

The web of the infill beam 28*c* and the insert board have a pattern of holes therethrough to admit mechanical fasteners from the outer side braces, the center side braces, and the other braces throughout the framework 6. The mechanical fasteners pass through the width of the aforementioned side braces and the width of the support beam. Upon at least one corner, where a support beam 28 connects to an end beam 27 where the side 5 meets the end 4 of the table seen from the outside, at least two mechanical fasteners extend vertically down through the end of the support beam. The mechanical fasteners are recessed so the planar surface throughout the framework is maintained.

By way of further explanation, the center length brace has four angle braces 19 for connecting to the cross braces 18. Each outer length brace 20 has four angle braces 19 that connect two to the cross brace 18 and one to the long end brace 24 and one to the short end brace 25. Regarding connections, each center side brace 21 connects to the support beam 28 with two fasteners, and each outer side brace 23 connects to the support beam 28 with three fasteners. Each short end brace 25 and each long end brace 24 connects to the end beam 27 with two fasteners.

Figure 7C:
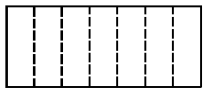
FIG. 7*c* shows the cross section of any of the braces.

As for construction of the members, the center length brace, the outer length braces, the cross braces, the outer side braces, the center side braces, the long end braces, and the short end braces are made of laminated hardwood as shown in FIG. 7*c*. The laminated hardwood has a plurality of strips glued upon their lengths and stacked, with at least six strips preferably. The strips are positioned so that the glue lines are vertical, or perpendicular, to the slates, for maximum bending resistance and minimal deflection. Generally, the aforementioned braces have a thickness of approximately 1.375 inches and a width of approximately 3.625 inches. The thickness and width of the braces cooperate so the table meets the deflection requirements as previously described.

Regarding lengths, the following approximate values for each member are provided, the center length brace, 24.75 inches; the outer length braces, 26.625 inches; the cross braces, 47 inches; the outer side braces, 20.125 inches; the center side braces, 9 inches; the long end braces, 9.5 inches; and, the short end braces 8.5 inches.

Figure 8:
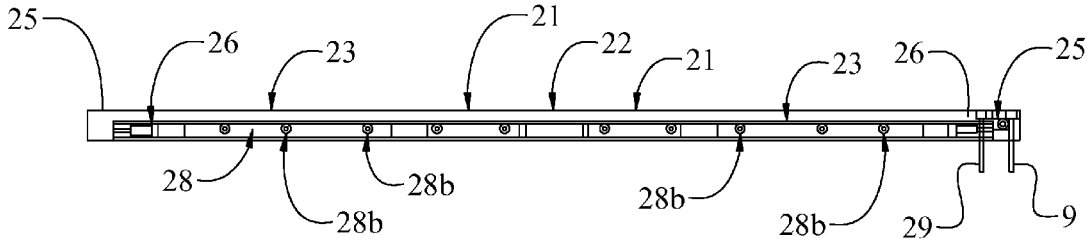
FIG. 8 is a side view of the framework, generally upon the length of the present invention.
Figure 9:
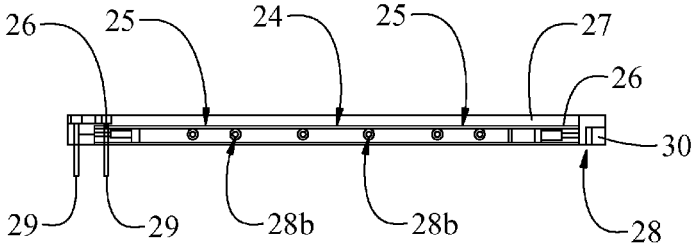
FIG. 9 is an end view of the framework, generally upon the width of the present invention.

With the framework components described above, FIG. 8 shows the assembled framework from the side. Each side panel, as in 5, has an infill beam 28*c* located in a routed recess 28*a* of the support beam 28 with a pattern of holes 28*b* outwardly. The holes, as described above, connect the various side braces to the infill beam. For each side brace, at least two bolts are used and span the width of the brace and the width of the side rail including the beam. Upon each end, the holes and cooperating fasteners are shown extending from the short end braces 25 into the end beams. Towards the right of this figure, the support beam connects to the end beam with at least one mechanical fastener and has at least two downwardly directed pins 29. These pins engage cooperating holes in a leg 3 of the table. In an alternate embodiment, the support beam connects to the end beam using two generally centered bolts, spaced apart vertically by approximately one inch Turning the framework, FIG. 9 describes an end view of the assembled framework. In this view, the short end braces 25 and the long end brace 24 mechanically fasten to the wooden end beam in centered holes through the width of the braces and the end beam. The mechanical fasteners are generally parallel to the plane of the slates. Here, the pins 29 for the leg 3 are shown to the left. Opposite the pins, the end of the support beam 28 is shown with the inserted board 30.

Figure 10:
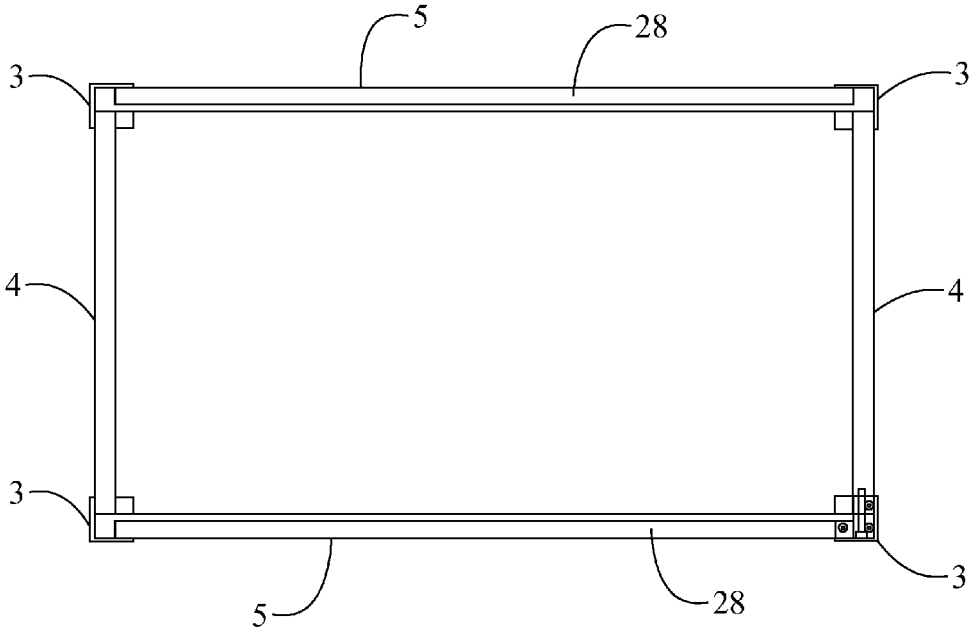
FIG. 10 is a top view of the structure to which the framework connects.

Viewing the structure from above in FIG. 10, the framework 6 rests upon the four legs 3 of the invention and the members of the framework are not shown in this figure for clarity. The side panels 5, with the included support beams 28 each span between two legs 3 and define the length of the table 1. The side panels are mutually parallel and spaced apart to define the width of the table 1. Upon each end of the side panels, the table has an end panel 4 that spans across two legs. Each end panel is generally perpendicular to a side panel and generally mutually parallel and spaced apart from the other end panel. The side panels 5 and the end panels 4 form a generally rectangular perimeter upon the four legs.

Figure 11:
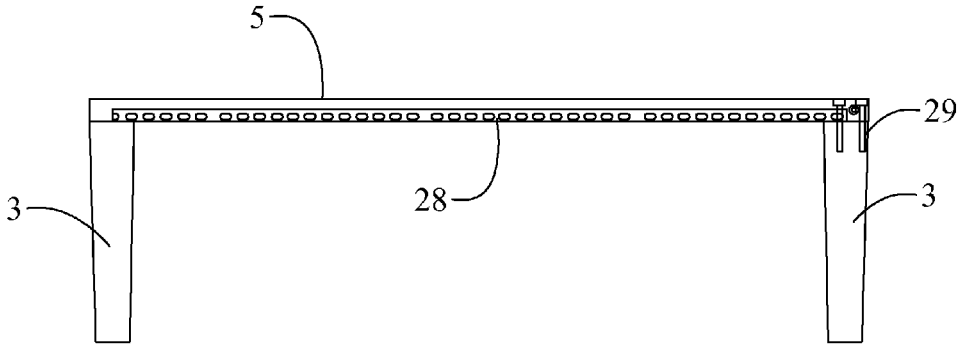
FIG. 11 is a side view of the structure of the present invention.

Turning the view of the table to the side, FIG. 11 shows the framework resting upon two of the legs 3, spaced apart for the length of the table. On each side, a side panel 5 spans between two legs and has the support beam 28 outwardly from the center of the structure. Towards the right in this figure, the framework has at least two pins 29 that descend into a leg 3 to secure the framework mechanically to a leg. The pins generally occupy predrilled holes in the leg and have threading to assist in gripping the legs.

Figure 12:
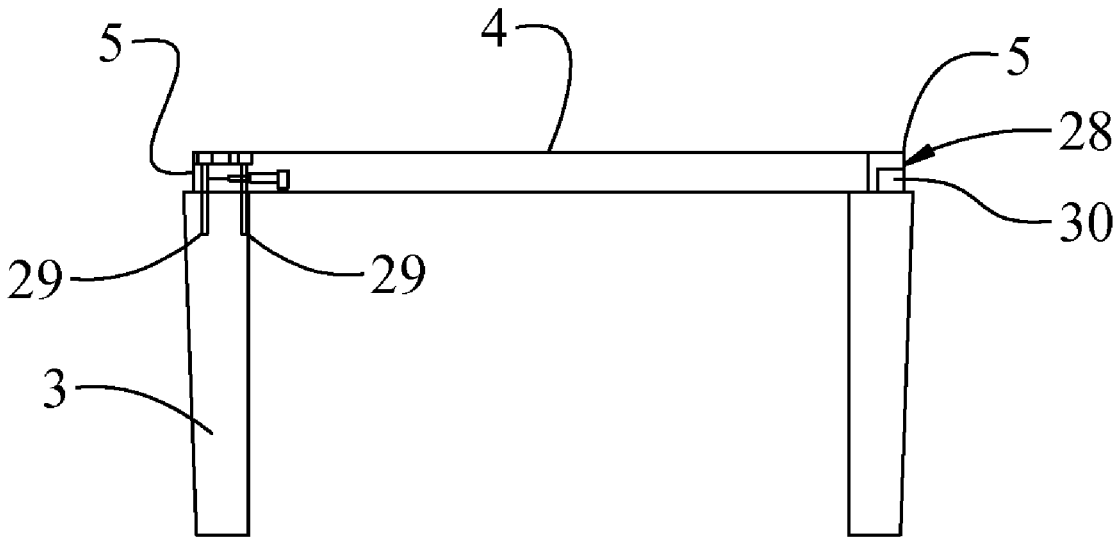
FIG. 12 is an end view of the structure of the present invention.

And turning the table again, FIG. 12 has an end view of the framework 6 resting upon two legs, spaced apart for the width of the table. Similar to FIG. 9, each end panel 4 rests upon two legs 3 and has an end of a support beam 28 shown upon the right and the pins 29 and at least one bolt that connect with a leg upon the left. The embedded pins provide precise positioning of the framework relative to the center of one leg so the width and length of the table can be set with the remaining legs. Alternatively, the support beams connect to the end beams using two vertically spaced bolts extending through the end of each end beam and into the support beams. The bolts are generally horizontal and parallel to the plane of the slates.

Figure 13:
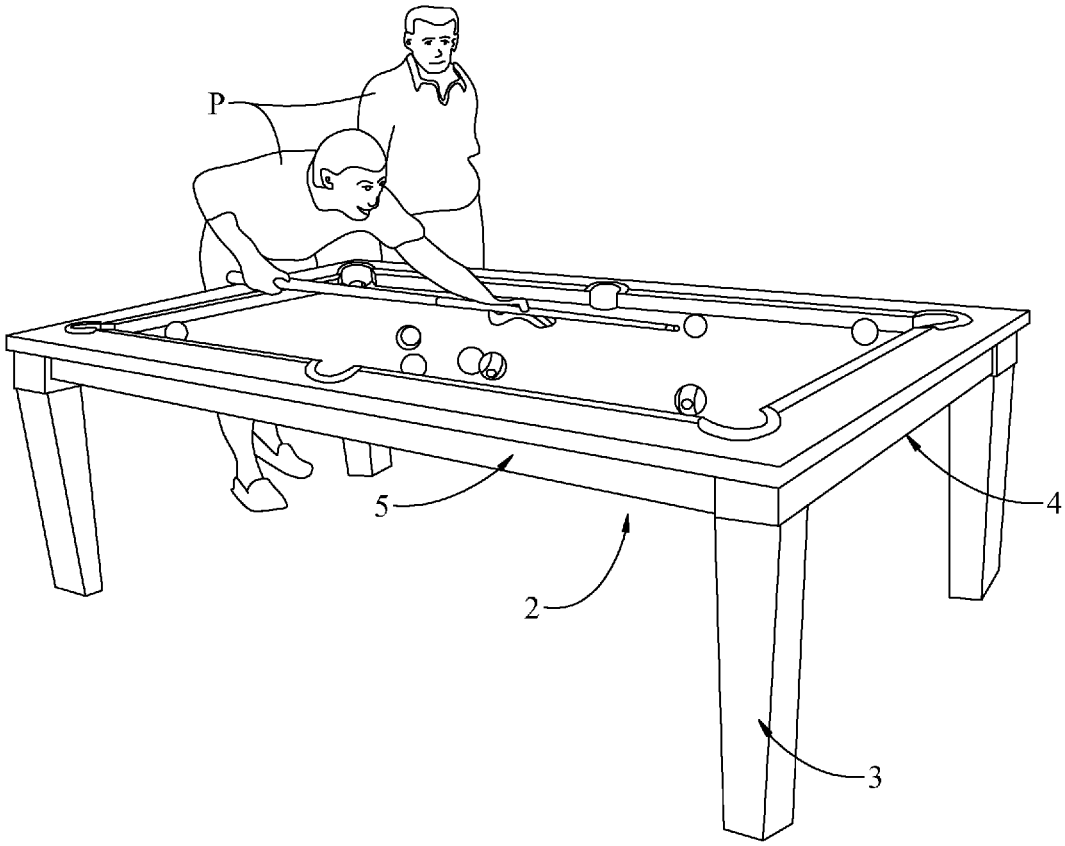
FIG. 13 shows the present invention used as a billiard table.

With the covers removed from the present invention as when dining is concluded, people play billiards in FIG. 13 just as they would upon a dedicated, single use, billiard table.

The present invention, though described for a standard size and shape billiard table, can be made in various sizes and shapes to suit the preferences of the user. The framework and its members may have various sizes to meet the user's shape preferences while still providing clearance below the billiard table for seated diners and meeting billiards deflection limits. An alternate embodiment includes a pedestal style table where the framework is supported in the center upon a single leg with a wide base. The framework and its members are strengthened for the cantilever loads imposed by the slates but still provide the clearance for seating below the table.

From the aforementioned description, a covered billiard table with high clearance has been described. This covered billiard table is uniquely capable of serving as a dining table with the legs of diners locating comfortably beneath and as a billiard table when the covers are removed. The covered billiard table has its high clearance through a combination of steel infill beams and wooden support beams and a laminated hardwood framework of limited thickness. The covered billiard table with high clearance and its various components may be manufactured from many materials, including but not limited to, wood, wood laminate, steel members having a wood veneer, steel, aluminum, polymers, polyvinyl chloride, high density polyethylene, polypropylene, nylon, rubber, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device for dining and billiard play standing upon a floor and beneath which sit diners, said device having at least one leg, comprising:

a pair of mutually parallel and spaced apart end panels;

a pair of mutually parallel and spaced apart side panels, said side panels being perpendicular to said end panels;

a pair of support beams, each located inside of one of said side panels;

a framework locating within said end panels and said side panels and forming a common horizontal plane, said framework having an overall thickness that in cooperation with said legs allows diners to sit comfortably below said framework;

at least one slate locating upon said framework, said framework maintaining said slate within deflection limits;

two outer covers, mutually spaced apart above said framework and said at least one slate, and locating adjacent to said end panels;

at least two inner covers locating above said framework and said slates, and within said outer covers and forming a common planar surface with said outer covers suitable for dining thereupon;

wherein said framework has a plurality of members including at least one center length brace, generally centered within said framework and parallel to said side panels;

at least two outer length braces, parallel to said side panels and to said center length brace, and spaced apart from said center length brace;

at least two cross braces, mutually parallel and spaced apart, generally parallel to said end beams, locating outwardly of said center length brace and generally perpendicular to said center length brace, and locating inwardly of said outer length braces and generally perpendicular to said outer length braces;

at least two end beams, mutually parallel and spaced apart, each locating proximate one of said end panels;

at least two outer side braces locating proximate each side panel, each pair of said outer side braces being generally collinear and generally perpendicular to said cross braces, and locating outwardly of said cross braces adjacent to said end beams;

at least two center side braces locating proximate each side panel and inwardly of said cross braces, each pair of said center side braces being generally collinear and generally perpendicular to said cross braces and mutually spaced apart, and each pair of said center side braces being generally centered upon each of said side panels;

at least one end brace centered upon each of said end beams, adjoining said outer length braces;

at least two side pocket frames, generally planar and coplanar with said outer said braces and having an opening therethrough, and at least two corner pocket frames, generally planar and coplanar with said outer said braces and having an opening therethrough; and, a plurality of angle braces, connecting said center length brace to said cross braces, said cross braces to said outer length braces, and said outer length braces to said short end braces and said long end braces.

2. The dining and billiard play device of claim 1 wherein said angle braces connect to said members of said framework using mechanical fasteners and adhesives.

3. The dining and billiard play device of claim 1 wherein said outer side braces and said center side braces connect to said side panels using mechanical fasteners, and said long end braces and said short end braces connect to said end beams using mechanical fasteners.

4. The dining and billiard play device of claim 1 wherein said at least one end brace includes:

at least two long end braces centered upon each of said end beams, locating between two of said outer length braces;

at least two short end braces proximate each end beam and outwardly of said long end braces, each pair of said short end braces being generally collinear and generally perpendicular to said outer length braces, and mutually spaced apart.

* * * * *